United States Patent [19]

Gargan

[11] 4,067,492

[45] Jan. 10, 1978

[54] SLOTTED DIVIDERS FOR SHIPPING CARTONS

[75] Inventor: Robert E. Gargan, Pinole, Calif.

[73] Assignee: Continental Paper Co., Union City, Calif.

[21] Appl. No.: 662,714

[22] Filed: Mar. 1, 1976

[51] Int. Cl.[2] ..... B65D 5/48; B65D 85/30

[52] U.S. Cl. ..... 229/42; 229/15; 229/28 R

[58] Field of Search ..... 229/42, 15, 28; 217/23

[56] References Cited

U.S. PATENT DOCUMENTS

| | | | |
|---|---|---|---|
| 1,860,567 | 5/1932 | Boeye | 229/42 X |
| 2,693,308 | 11/1954 | Giroux et al. | 229/28 R |
| 2,697,544 | 12/1954 | Morand | 229/51 DB |
| 2,717,713 | 9/1955 | Wasyluka | 229/15 X |
| 3,756,496 | 9/1973 | Oostdik | 229/42 X |
| 3,758,018 | 9/1973 | Black | 229/15 |
| 3,921,891 | 11/1975 | Gorham | 229/28 R |

OTHER PUBLICATIONS

RCA TB 282, 6–1959, RCA Tech Notes.

*Primary Examiner*—Davis T. Moorhead
*Attorney, Agent, or Firm*—Lowhurst & Aine

[57] ABSTRACT

A divider structure for a shipping carton consists of first and second divider members, the patterns for which are preferably slotted and scored into a common blank so that the blank may be separated, along a scored part line, into two blanks, one for each of the two divider members. The two divider members are to be interlocked together for division of the carton into a plurality of compartments. Each divider member is preferably scored for folding and includes a central intermediate panel portion and a pair of outer wing panel portions on opposite sides. The wing panels are folded up toward each other to define a generally U-shaped channel member. One of the channel divider members is slotted laterally across the intermediate panel portion and into the wing panels, whereas the other channel divider member is slotted from the outer edges of the wing panels toward the intermediate panel portion. The two slotted U-shaped channel members are interlocked together in orthogonal relation to form the composite divider structure for partitioning the carton. Each divider means is heavily scored along the fold lines where the outer wing panels join the intermediate panel to facilitate parting of a given portion of the outer wing panel from the intermediate panel for folding of that portion of the divider out of the way to effectively remove the divider between two adjacent compartments, thereby opening up or enlarging one or more compartments.

3 Claims, 4 Drawing Figures

SLOTTED DIVIDERS FOR SHIPPING CARTONS

BACKGROUND OF THE INVENTION

The present invention relates in general to dividers for shipping cartons and more particularly to improved slotted dividers to be placed together in interlocked relation within the carton to be partitioned.

DESCRIPTION OF THE PRIOR ART

Heretofore, interlocking dividers for shipping cartons have comprised at least four slotted divider members. Each divider member was slotted from one side edge into a region approximately midway of its depth by means of a plurality of generally parallel slots. The divider members were assembled in orthogonal relationship in an interlocking fashion to partition a shipping container into a plurality of individual compartments, for example, nine compartments.

One of the problems with this prior art divider arrangement is that a substantial amount of labor is involved in assembling the four or more interlocking dividers, in that the dividers must be held in parallel spaced relation for interdigitation and interlocking thereof. As a consequence, a substantial amount of labor is involved in assembling the divider structures.

Therefore, it has been common practice, in the moving and storage industry, to acquire the divider structures from the supplier for a dishpack carton in a preassembled state. The preassembled dividers are then collapsed for storage.

However, it would be desirable to provide an improved divider cell structure for dishpack cartons which is less costly of assembly and which can be stored in less space.

SUMMARY OF THE PRESENT INVENTION

The principal object of the present invention is the provision of an improved divider structure for shipping cartons.

In one feature of the present invention, the divider structure for partitioning a shipping carton into a plurality of compartments includes first and second divider members, each including a central panel portion and a pair of outer wing panel portions so that when the wing panels are folded toward each other, the divider members form a generally U-shaped structure. One of the divider members is slotted laterally of the intermediate panel and generally midway into the outer wing panels by a pair of slots, whereas the other divider member has the outer wing panels slotted, by a pair of slots, running from the outer edge toward the central panel. The two slotted U-shaped divider members are then interdigitated in orthogonal interlocking relation to form the composite carton divider structure.

In another feature of the present invention, each of the U-shaped divider members is heavily scored along the fold lines between the outer wing panels and intermediate panel portions. The region of heavy scoring forms a part line extending away from the region between the slots so that when the first and second divider members are assembled in interlocking relation, the outer wing panels may be readily separated from the intermediate panel portion for folding of the wing panel portion so as to enlarge compartments by essentially folding out of the way the wing panel divider portion therebetween.

In another feature of the present invention, the two different types of divider members are formed in a common blank so that they can be separated along a scored part line, whereby the storage space required for a given number of divider structures is reduced because the divider blanks lay flat one upon the other.

Other features and advantages of the present invention will become apparent upon a perusal of the following specification taken in connection with the accompanying drawings wherein:

DESCRIPTION OF THE PREFERRED EMBODIMENTS

Figure 1:
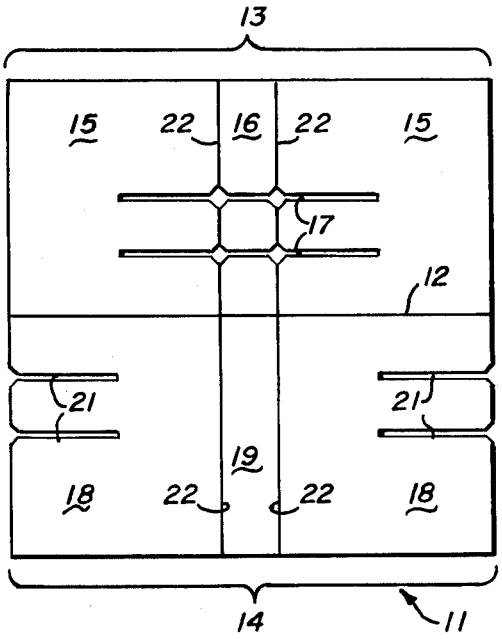
FIG. 1 is a plan view of a divider blank incorporating features of the present invention.

Referring now to FIG. 1, there is shown a shipping carton divider blank 11 incorporating features of the present invention. More particularly, the blank 11 comprises a square of partitioning material, such as ⅛ inch thick corrugated pasteboard. The pasteboard blank 11 is heavily scored along a horizontal part line 12 so that the blank can be readily parted into first and second divider members 13 and 14, respectively. In a typical example, the part line scoring 12 takes the form of a series of cuts, as of 4–5 inches in length, passing completely through the paper board 11, such adjacent cuts being separated by hinge-like regions, as of 0.875 inch in length including a central cut, as of 0.625 inch in length, passing through the pasteboard material and leaving a pair of uncut hinges, as of 0.124 inch in length, on opposite sides of the central cut. Divider members 13 and 14 are readily parted by merely grasping the board 11 and pulling apart the two halves 13 and 14.

The first divider member 13 includes a pair of outer wing panel portions 15 interconnected by an intermediate panel portion 16. In a typical example, the intermediate panel portion has a width of 5 inches and a length of 17.5 inches, whereas the outer wing panels 15 each have a length of 17.5 inches and a width of 13 inches. First divider member 13 is slotted by means of a pair of parallel slots 17 extending laterally through the intermediate panel 16 and into each of the outer wing panels 15 to a point approximately midway of the width of each of the outer wing panels 15. In a typical example, the slots 17 have a width of 0.250 inch.

Similarly, the second divider member 14 includes a pair of outer wing panels 18 interconnected by means of an intermediate panel portion 19. The outer wing panel portions 18 are slotted with a pair of parallel slots 21 extending inwardly of the outer wing panel portions 18 from the outer side edges thereof toward the intermediate panel portions 19. The slots 21 extend inwardly to a point substantially midway of the width of each of the outer wing panel portions 18. The spacing between the adjacent slots 21 is the same as the spacing between adjacent slots 17 in the first divider member 13. Each of the second slots 21 has the same width as the first slots 17.

The outer wing panels 15 of the first and second divider members 13 and 14 each fold toward each other along fold lines 22 forming the side boundaries of the intermediate panel portions 16 and 19 where they adjoin the outer wing panels 15 and 18, respectively. The fold lines 22 are heavily scored as by slicing therethrough in a series of cuts consisting of a long cut, as of 3 inches in length, separated from the adjacent long cut by an uncut region of the blank 11 having a length as of 0.125 inch. The region of the fold lines 22 disposed in between the respective pairs of parallel slots 17 and 21 is not scored or if scored, is scored very lightly in comparison to the scoring of the remaining portion of the fold lines 22 which extend outwardly along the fold lines 22 to the end boundaries of the individual divider members 13 and 14. These regions of relative heavily scoring along the fold lines 22 are provided to facilitate separation of the outer wing panels 15 and 18 from the intermediate panels along the fold lines 22 where the dividers are assembled in interlocking relation as more fully disclosed below with regard to FIGS. 2–4.

Figure 2:
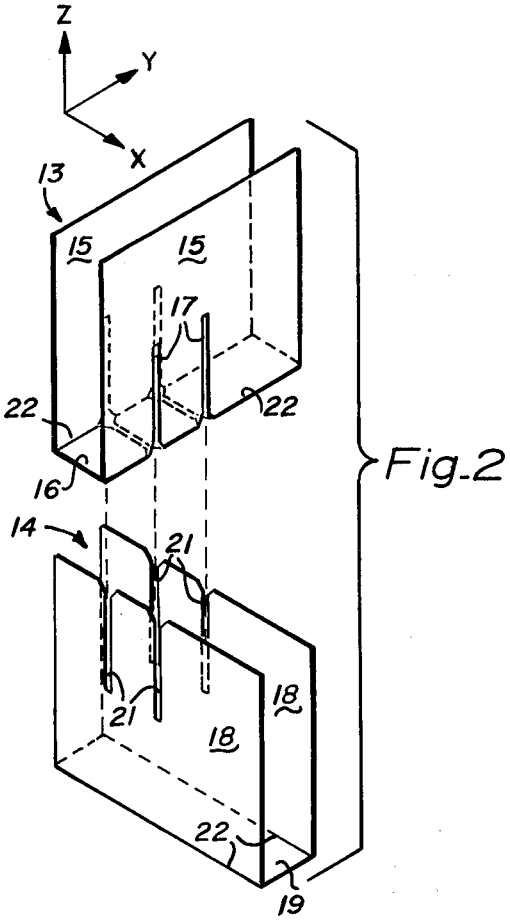
FIG. 2 is an exploded view of the carton divider structure of the present invention as derived from the blank of FIG. 1.
Figure 3:
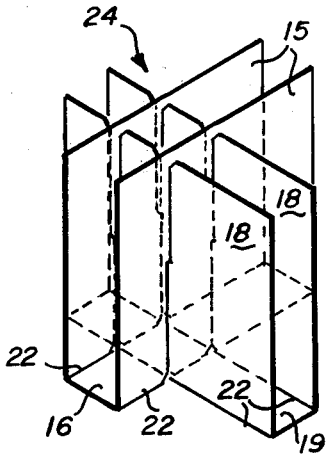
FIG. 3 is a perspective view of the assembled composite divider structure of the present invention.
Figure 4:
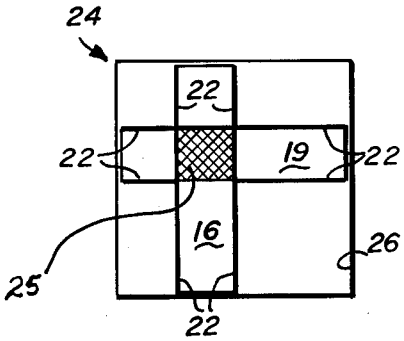
FIG. 4 is a reduced plan view of the divider structure of FIG. 3 as placed within a carton for partitioning thereof.

Referring now to FIG. 2, it is shown how the first and second divider members 13 and 14, respectively, are folded and oriented in orthogonal relaton to be interdigitated in interlocking relation to form the composite carton divider structure, as shown in FIGS. 3 and 4. More particularly, the outer wing panel portions 15 and 18, of the respective divider members 13 and 14, are folded toward each other along the fold lines 22 to define a pair of generally U-shaped divider members 13 and 14.

The divider members 13 and 14 are then oriented in an orthogonal relation as shown in FIG. 2. More particularly, the wing panels 15 and 18 are oriented parallel to the Z-axis, whereas the longitudinal axis of the intermediate panel portion 16 of the first member 13 is oriented parallel to the Y-axis and the longitudinal axis of the inermediate panel portion 19 of the second divider member 14 is oriented parallel to the X-axis. The slots 17 in the first member 13 are oriented vertically along the Z-axis above the corresponding slots 21 in the second divider member 14.

The two members are then interdigitated by pressing them together so that the intermediate panel portions 16 and 19 are adjacent each other in abutting relation in the central region 25 (see FIG. 4) of the composite divider structure 24. When the divider members 13 and 14 are assembled as described with regard to FIG. 2, the composite divider structure 24 is as shown in FIGS. 3 and 4. As more clearly shown in FIGS. 1 and 4, when the composite divider structure 24 is to be employed for partitioning a dish shipping or storage carton 26, the slots 17 and 21 are not symmetrically placed relative to the longitudinal axis of each of the intermediate panel portions 16 and 19. More particularly, the slots 17 and 21 are displaced slightly toward one end of the respective intermediate panel portions 16 and 19 so that when the divider members 13 and 14 are assembled in interlocked relation as shown in FIGS. 3 and 4, the nine shipping compartments formed by the composite divider structure 24, in the carton 26, provide a plurality of different sized compartments to facilitate packing dishes of various different sizes.

In addition, the relative heavily scored regions of the fold lines 22 which extend along the fold lines away from the central overlying region 25 to the outer side edges of the respective intermediate panel portions 16 and 19 allow adjustment of the size of the individual shipping compartments. More particularly, the individual compartment sizes can be increased by separating the outer wing panel portions 15 and 18 from the respective intermediate panel portions 16 and 19 along the heavily scored portions of the fold lines 22 and by folding the separated divider portion out of the way. In this manner, the divider between adjacent compartments is effectively removed for expanding adjacent compartments into one larger compartment.

The advantages to the use of the composite divider structure 24 and the divider blank 11 of the present invention includes that the blanks 11 are easily stored as they lie flat and take up less storage space than the previously collapsed preassembled divider structures which consisted of essentially four interdigitated outer wing panels 15 and 18. In addition, the amount of labor involved in assembling the composite divider structure 24 from the blank 11 of the present invention is substantially reduced as contrasted with the amount of labor involved in assembling the four individual outer wing panel members of the prior art. This labor saving comes about because the intermediate panels 16 and 19 serve to hold the folded outer wing panels 15 and 18 in the prescribed parallel relation to faciltate interdigitation and interlocking thereof in the manner as shown in FIG. 2.

What is claimed is:

1. In a shipping carton divider:

first and second carton divider means to be fitted together in interlocked relation for partitioning the shipping carton into a plurality of shipping compartments, each of said divider means including a pair of outer wing panels interconnected by an intermediate panel, each of said divider means to be folded so that the outer wing panels are folded toward each other along a fold line coincident with the juncture of the outer wing panels with said intermediate panel so that when the outer wing panel portions are foled toward each other, each divider means takes a generally U-shape with the outer wing panels forming the opposed side walls of the U-shaped channel and with the intermediate panel portion forming the base of the U-shaped channel;

said first divider means including a pair of parallel slots formed therein running laterally of said intermediate panel and extending from said intermediate panel into and terminating within each of said outer wing panels;

said second divider means including a pair of parallel slots extending into each of said outer wing panels from the outer side edges thereof toward said intermediate panel; and at least one of said divider means being relatively heavily scored over at least a portion of said fold line at the juncture of said intermediate panel and at least one of said outer wing panels, said relatively heavily scored portion of said fold line forming a parting line facilitating separation of said outer wing panel from said intermediate panel along said relatively heavily scored parting line region to allow folding over of a portion of said outer wing panel to enlarge the size of a compartment formed by interdigitated ones of said folded first and second divider means.

2. The apparatus of claim 1 wherein each of said first and second divider means is relatively heavily scored along at least a portion of said fold lines defined along the side boundaries between said intermediate panel and said adjoining outer wing panels to form parting lines to facilitate separation of said outer wing panels from said intermediate panel along said scored parting line region to allow folding over a portion of said outer wing panel to enlarge the size of the compartment formed by interdigitated ones of said folded first and second divider means.

3. The apparatus of claim 2 wherein said scoring is disposed externally of the region between said parallel slots in respective ones of said divider means to facilitate parting of said outer wing panels from said intermediate panel for enlargement of the compartments formed by interdigitated ones of said first and second divider means.

* * * * *